United States Patent [19]

Guttmann

[11] 4,405,366

[45] Sep. 20, 1983

[54] METHOD AND DEVICE FOR GENERATING A CONVECTIVE REACTION SYSTEM BETWEEN A REACTION AGENT AND A MOLTEN BATH

[75] Inventor: Friedrich W. Guttmann, Bergisch Gladbach, Fed. Rep. of Germany

[73] Assignee: Klockner-Humboldt-Deutz AG, Fed. Rep. of Germany

[21] Appl. No.: 276,837

[22] Filed: Jun. 24, 1981

Related U.S. Application Data

[63] Continuation of Ser. No. 144,274, Apr. 28, 1980.

[30] Foreign Application Priority Data

Jun. 20, 1979 [DE] Fed. Rep. of Germany ..... 2924761

[51] Int. Cl.[3] ..... C22B 9/00

[52] U.S. Cl. ..... 75/93 E; 75/51; 75/52; 75/59

[58] Field of Search ..... 75/93 E, 51, 52, 53, 75/57, 59, 60

[56] References Cited

U.S. PATENT DOCUMENTS

| | | | |
|---|---|---|---|
| 2,015,691 | 10/1935 | Perrin | 75/57 |
| 2,100,264 | 11/1937 | Perrin | 75/57 |
| 3,706,549 | 12/1972 | Knuppel | 75/60 |
| 3,844,768 | 10/1974 | Leroy | 75/60 |
| 3,902,895 | 9/1975 | Wuth | 75/76 |

*Primary Examiner*—P. D. Rosenberg

*Attorney, Agent, or Firm*—Hill, Van Santen, Steadman, Chiara & Simpson

[57] ABSTRACT

Liquid droplets in a freely falling stream are applied as a liquid reaction agent in the generation of a spatially-limited convective reaction system in such a way as that at least a portion of the droplets penetrate into the surface of the molten bath to interact with the molten metal.

18 Claims, 3 Drawing Figures

METHOD AND DEVICE FOR GENERATING A CONVECTIVE REACTION SYSTEM BETWEEN A REACTION AGENT AND A MOLTEN BATH

This is a continuation of application Ser. No. 144,274, filed 4/28/80.

BACKGROUND OF THE INVENTION

1. Field of the Invention

The present invention relates to a method and to a device for generating a reaction system, particularly a spatially limited convective reaction system, between a reaction agent and a molten bath, whereby the reaction agent is applied in a free stream to the surface of the molten bath.

2. Description of the Prior Art

A method of the above general type is disclosed, for example, in U.S. Pat. No. 3,902,985, which is fully incorporated herein by this reference. U.S. Pat. No. 3,902,895 relates to a method for the separation of foreign elements from a molten metal bath, particularly copper, wherein reaction gases in the form of a highly-concentrated, high-energy stream are blown nearly perpendicularly into the surface of the bath with such a force that the melt beneath the blow impression is excited to a toroidal rotation, whereby a spatially limited reaction unit with a defined material junction is generated.

The known method, whereby reaction gases were brought into contact with a molten bath under specific conditions, led to considerable improvements in comparison to the state of the art at the time of that invention. In particular, this first allowed a continuous refining method by strictly reproducible and controllable, defined substance transmutations, whereby optimum results were achieved at an economic expense.

However, a loss of reaction agent cannot be avoided in such a reaction system in which the reaction medium is blown onto the molten bath in the gaseous phase and in a free stream. This is true, in particular, because the gas is deflected in the stagnation point of the stream, and a rising layer stream of compressed gas prevents the contact of a partial stream of the gas with the molten bath. This part of the reaction gas in the partial stream is, therefore, lost for the direct mass transfer between the gas and the molten bath.

SUMMARY OF THE INVENTION

The object of the present invention is to improve the known method for generating a reaction system, particularly a spatially limited convection reaction system, between a reaction agent and a molten bath, whereby the reaction agent is applied to the surface of the molten bath in a free stream, and, in particular, to thereby prevent losses of the reaction agent in the reaction system. Attendant thereto, the present invention has an object of realizing the improvement in a simple manner and with the most economical means possible.

The above object is achieved in that a liquid is employed as the reaction agent.

The use of a liquid as the reaction agent brings forth the following advantages:

1. The liquid stream has a higher kinetic energy than a gas stream of approximately equal velocity. As a result, the liquid forming the stream reaches into the target area, namely onto the molten bath, securely and nearly loss-free.

2. As a result of defervescence and in the protection of a steam cover (Leydenfrost Effect), individual droplets arrive onto and into the molten bath with the assistance of their kinetic energy, whereby, in intimate contact with the bath, they cause an optimum reaction with intensive material transmutations.

3. A liquid as a carrier of chemical reaction agents has advantages in comparison to gaseous reactants with respect to the multitude of possible chemical contents and as a result of the favorable manipulation, at least in a series of applications.

It is provided in an advantageous embodiment of the invention that the liquid is atomized into a multitude of fine droplets and that the droplets, as a collective, are bundled to form an essentially closed stream, whereby approximately parallel flight paths are forced onto the droplets, given approximately equal velocities. It is further provided that the droplets, particularly in the collective, are provided with such a high kinetic energy that at least one part of the droplets penetrate into the molten bath.

These features produce the advantages that the fluid stream receives a large reactive surface during the splitting of the same into a multitude of fine droplets without having its kinetic energy reduced.

In that at least one part of the droplets penetrates into the molten bath, the loss of reaction agent is reduced to a minimum and the course of the reaction is thereby simultaneously intensified.

It is provided in a development of the invention that a guide device is employed for bundling the droplets. Thereby, in addition to this feature, the droplet stream can be surrounded with a jacket gas.

The advantage of this feature is that the jacket gas prevents friction of the droplet stream with the surrounding atmosphere and thus promotes the bundling of the droplet stream. This is particularly true when, according to a further feature of the invention, the jacket gas, in relationship to the stream, exhibits an approximately equal, but under certain conditions, also a higher velocity.

With the above feature, the stream can be formed of a bundle of individual, small streams. This has the advantage that approximately parallel flight paths and approximately equal velocities can be achieved in a simple manner.

An advantageous employment of the invention arises when liquid hydrocarbons are blown onto a metal melt.

With this feature of the invention, the measure can be taken that the stream is a liquid with a low boiling point such as, for example, propane, and that the jacket gas is a water stream, upon whose common incidence on the hot metal bath, a highly-reducing, reformed gas mixture arises.

This feature has the advantage, in particular, that a separate device for producing reformed gas is eliminated, whereby, in addition, the creation of the reduction gas in statu nascendi becomes a particularly high reduction potential.

It is proven particularly advantageous for generating an optimum stream that the pressure of the liquid reaction medium in front of the nozzle lies in the range between 1.5 and 25 bar, preferably in that range at approximately 15 bar.

A further advantageous employment of the method of the invention arises from its employment for blowing liquid reaction agents onto and/or into a bath of molten slag.

A device for implementing the method of the invention, and constructed in accordance with the invention, comprises at atomization device having a nozzle, the nozzle having a front shoe which is equipped with a multitude of approximately parallel nozzle bores lying in close proximity to one another.

Such a device has the advantage that it is extremely simple and uncomplicated, can be easily manufactured, is economical and accords completely with the purpose in its function.

The atomization device, however, can also exhibit a separate guide device which is attached to the front shoe and preferably consists of a guide pipe.

An embodiment of the device provides that the nozzle and/or guide pipe is surrounded by an annular channel which has a connection for the introduction of jacket gas, as well as at least one discharge aperture for the jacket gas.

A further advantageous embodiment provides that a jacket tube concentrically enclosing the nozzle and/or the guide pipe is connected to an annular channel, whereby a discharge aperture of the annular channel discharges into the annular gap between the guide pipe and the jacket tube.

Another, likewise advantageous embodiment of the atomization device, provides that the nozzle and/or the front shoe be designed as a full-cone spray nozzle.

An advantageous, yet optimum overall arrangement, finally, arises in that the atomization device and/or the nozzle be arranged above the molten bath so as to be adjustable in height with a lance.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
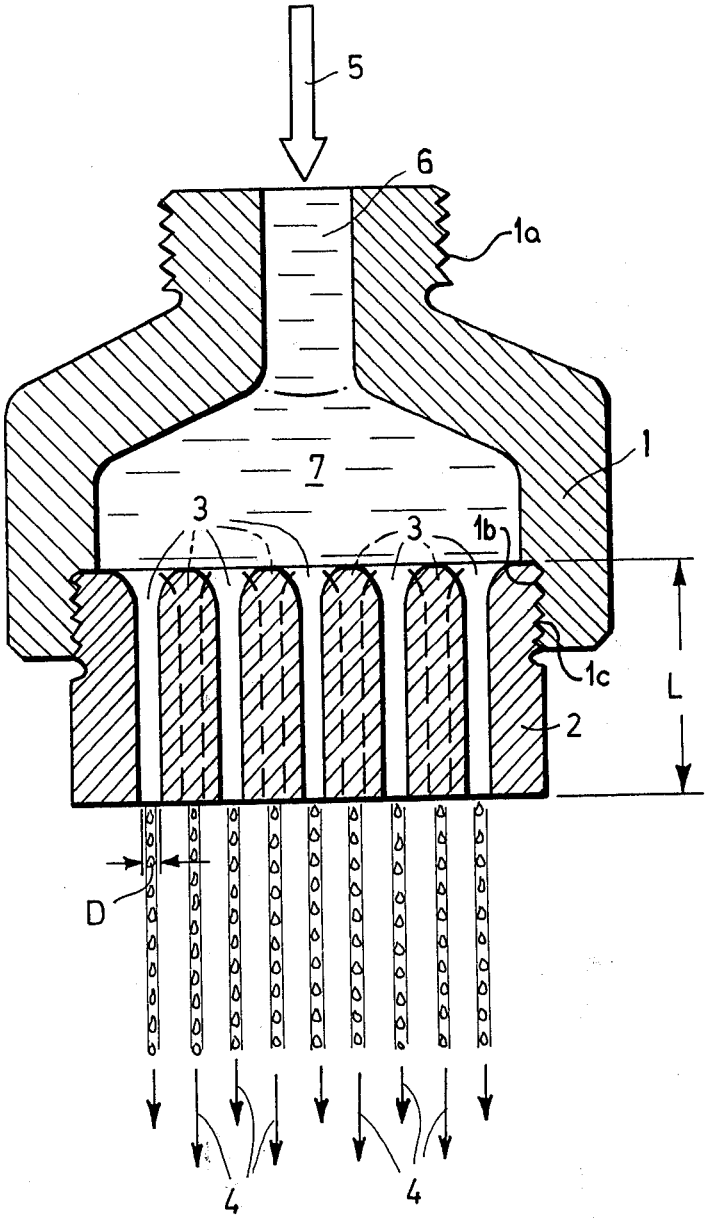
FIG. 1 is a sectional view through a nozzle and front shoe of a device constructed in accordance with the present invention, in which the front shoe represents the guide device.
Figure 2:
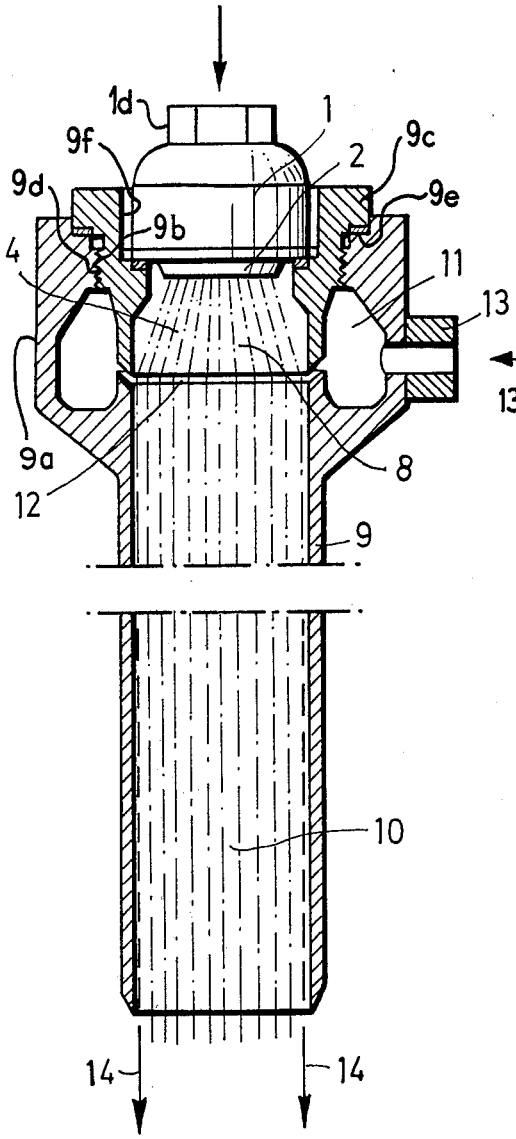
FIG. 2 is a partial sectional view of a device constructed in accordance with the present invention in which the nozzle is designed as a full-cone spray nozzle and is equipped with a guide pipe as well as with an annular channel for the introduction of jacket gas.
Figure 3:
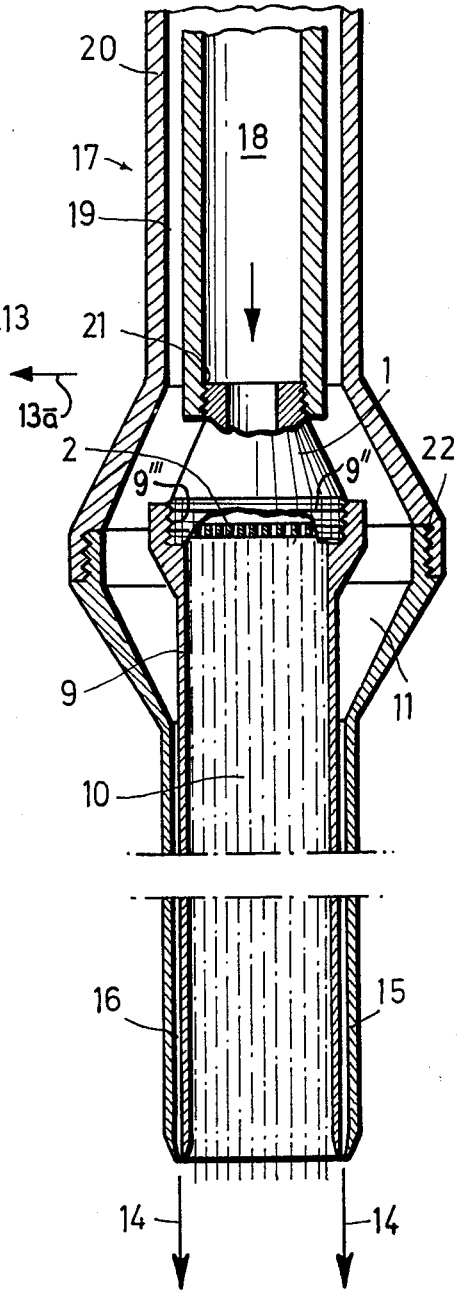
FIG. 3 illustrates an embodiment of the device of the invention, in section, in which the device has a guide pipe and a jacket tube.

Referring to FIG. 1, a nozzle 1 has an attachment thread 1*a* (or wrench flats 1*d* as in FIG. 2) for attachment to a pipe (FIG. 3). The nozzle 1 is also threadedly secured at 1*b*, 1*c* to a front shoe 2. The front shoe 2 has a multitude of substantially parallel bores 3. As a result of the length L of the nozzle bores 3 in ratio to their diameter D, the front shoe 2 acts as a guide device for a plurality of liquid streams 4. The liquid, as indicated by an arrow 5, enters the nozzle 1 through an aperture 6, is distributed in the interior space 7 of the nozzle, and is forced under pressure into the channels 3 which convert the liquid into a bundle of approximately parallel streams 4 having high velocity.

According to FIG. 2, the nozzle 1 with the front shoe 2 is developed into a full-cone spray nozzle. The full-cone 8 is formed by the streams 4 and is collected into a focused stream 10 of approximately the same direction and same velocity by the introduction of a jacket gas in conjunction with a guide plate 9. The nozzle 1 is surrounded by an annular channel 11 which has an annular gap 12 for the introduction of jacket gas between the guide pipe 9 and the concentrated stream 10, and also has a connection nozzle 13 for the introduction of the jacket gas into the annular channel 11, as indicated by an arrow 13*a*. The guide pipe 9 includes an upper end 9*a* which receives a nut 9*c* by way of respective threads 9*b* and 9*d*. The nut 9*c* is sealed to the portion 9*a* by a gasket 9*e*. The nut 9*c* also includes a bore 9*f* which receives the nozzle 1. The nozzle 1 may be attached to the nut 9*c* by any suitable means, such as threads.

The jacket gas surrounding the liquid concentrated stream 10 is indicated, only schematically, by means of the arrows 14.

In the device according to FIG. 3, in which identical parts of the previous figures have been provided with the same reference characters, the guide pipe 9' includes threads 9'' for connection to threads 9''' provided on the nozzle 1. The guide pipe 9' is surrounded by a jacket tube 15. The jacket gas emerges from an annular gap 16 formed between the guide pipe 9' and the jacket tube 15 parallel to the liquid stream 10 as a concentrated veil 14 having high velocity.

The nozzle 1 with the front shoe 2, the guide pipe 9' and the jacket tube 15 are connected to a lance 17. The lance comprises an inner pipe 18, and an outer pipe 20. With this construction, the inner pipe 18 of the lance 17 conducts the liquid, whereas the jacket gas is supplied through an annular gap 19 between the inner pipe 18 and the outer pipe 20. The nozzle arrangement, 1, 2, 9' and the lance 17, 18, 19, 20 are connected to one another, medium-tight, by threads as indicated at 21, 22.

The invention is not limited to the examples discussed. These only represent exemplary selections of possible structural embodiments of the device of the present invention. Changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. In a method for generating a spatially-limited convective reaction system between a reaction agent and a molten metal bath, the improvement comprising the step of:

forming and applying liquid droplets, in a freely falling stream, as a liquid reaction agent so that at least a portion of the droplets penetrate into the surface of the molten bath to interact with the molten metal.

2. In a method for generating a spatially-limited convective reaction system between a reaction agent and a molten bath comprising molten slag, the improvement comprising the step of:

blowing, in a freely falling stream, a liquid reaction agent as liquid droplets so that at least a portion of the droplets penetrate into the molten slag to interact therewith.

3. In a method for generating a spatially-limited convective reaction system between a reaction agent and a molten bath comprising molten slag, the improvement comprising the steps of:

blowing, in a freely falling stream, a liquid reaction agent as liquid droplets so that at least a portion of the droplets penetrate into the molten slag; and guiding the freely falling stream by blowing a jacket gas about the stream.

4. In a method for generating a spatially-limited convective reaction system between a reaction agent and a molten metal bath, the improvement comprising the steps of:

atomizing a liquid reaction agent into at least one stream of fine droplets;

flowing a jacket gas about the stream of liquid reaction agent droplets; and applying, in a freely falling stream, the gas-jacketed stream of liquid reaction agent droplets so that at least a portion of the droplets penetrate into the molten metal bath to interact with the molten metal.

5. In a method for generating a spatially-limited convective reaction system between a reaction agent and a molten metal bath, the improvement comprising the steps of:

atomizing a liquid hydrocarbon, as a liquid reaction agent, into at least one stream of fine droplets; and applying, in a freely falling steam, the stream of atomized fine droplets so that at least a portion of the droplets penetrate into the surface of the molten metal bath to interact with the molten metal.

6. The improved method of claim 5, wherein the step of atomizing a liquid hydrocarbon is further defined as:

atomizing propane.

7. The improved method of claim 6, and further comprising the step of:

flowing a water stream as a jacket about the stream of propane droplets to create a highly-reducing, reformed gas mixture upon incidence with the molten metal bath.

8. The improved method of claim 1, wherein the step of applying is further defined as:

atomizing the liquid reaction agent into substreams of fine droplets; and concentrating the substreams into an essentially closed stream in which the droplets have substantially parallel flight paths and substantially equal velocities.

9. The improved method of claim 8, wherein the step of applying a further defined as:

imparting a sufficiently high kinetic energy to the droplets that a part thereof penetrate into the molten bath.

10. The improved method of claim 9, wherein the step of concentrating is further defined as:

guiding the substreams through a confining guide pipe.

11. The improved method of claim 1, and further comprising the step of:

flowing a jacket gas about the stream of liquid reaction agent.

12. The improved method of claim 11, wherein the step of flowing a jacket gas is further defined as:

flowing the jacket gas at a velocity approximately equal to the velocity of the liquid reaction agent.

13. The improved method of claim 11, wherein the step of flowing a jacket gas is further defined as:

flowing the jacket gas at a velocity which is greater than the velocity of the liquid reaction agent.

14. The improved method of claim 1, wherein the step of applying is further defined as:

applying a liquid reaction agent including liquid hydrocarbons.

15. The improved method of claim 11, wherein the steps of applying a liquid reaction agent and flowing a jacket gas are further defined as:

applying a low boiling point liquid reaction agent; and flowing a water stream as the jacket gas.

16. The improved method of claim 11, wherein the steps of applying a liquid reaction medium and flowing a jacket gas are further defined as:

applying propane as the liquid reaction agent; and flowing a water stream as the jacket gas.

17. The improved method of claim 1, wherein the step of applying is further defined as:

forcing the liquid reaction agent through a nozzle to create a pressure in front of the nozzle in the range between 1 and 25 bar.

18. The improved method of claim 1, wherein the step of applying is further defined as:

forcing the liquid reaction agent through a nozzle to create a pressure in front of the nozzle of approximately 15 bar.

* * * * *